US008177988B2

(12) United States Patent
Komiyama et al.

(10) Patent No.: US 8,177,988 B2
(45) Date of Patent: May 15, 2012

(54) METHOD FOR MANUFACTURING LIQUID DISCHARGE HEAD

(75) Inventors: Hiroto Komiyama, Tokyo (JP); Hirokazu Komuro, Yokohama (JP); Satoshi Ibe, Yokohama (JP); Takuya Hatsui, Tokyo (JP); Keisuke Kishimoto, Yokohama (JP); Shimpei Otaka, Yokohama (JP); Sadayoshi Sakuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 879 days.

(21) Appl. No.: 12/203,549

(22) Filed: Sep. 3, 2008

(65) Prior Publication Data

US 2009/0065476 A1 Mar. 12, 2009

(30) Foreign Application Priority Data

Sep. 6, 2007 (JP) ..... 2007-231352

(51) Int. Cl.
*H01B 13/00* (2006.01)

(52) U.S. Cl. ..... 216/17; 216/27; 216/94; 216/96; 438/21; 438/706

(58) Field of Classification Search ..... None
See application file for complete search history.

(56) References Cited

U.S. PATENT DOCUMENTS

| | | | | |
|---|---|---|---|---|
| 6,143,190 | A | 11/2000 | Yagi et al. | |
| 6,527,377 | B1 * | 3/2003 | Ikegame et al. | 347/56 |
| 6,563,079 | B1 | 5/2003 | Umetsu et al. | |
| 6,659,588 | B2 * | 12/2003 | Ikegame et al. | 347/40 |
| 7,250,113 | B2 | 7/2007 | Komuro et al. | |
| 7,727,411 | B2 * | 6/2010 | Yamamuro et al. | 216/27 |
| 2007/0019043 | A1 * | 1/2007 | Oya | 347/70 |
| 2007/0212891 | A1 * | 9/2007 | Yamamuro et al. | 438/733 |
| 2008/0076197 | A1 | 3/2008 | Komuro et al. | |
| 2009/0065472 | A1 | 3/2009 | Asai et al. | |
| 2009/0065473 | A1 | 3/2009 | Ibe et al. | |
| 2009/0065481 | A1 | 3/2009 | Kishimoto et al. | |
| 2009/0065482 | A1 | 3/2009 | Komiyama et al. | |

* cited by examiner

*Primary Examiner* — Duy Deo
(74) *Attorney, Agent, or Firm* — Fitzpatrick, Cella, Harper & Scinto

(57) ABSTRACT

A method for manufacturing a substrate for a liquid discharge head having a silicon substrate provided with a supply port of a liquid comprises steps of preparing a substrate which is provided with a passive film on one side face thereof, has a first recess and a second recess provided therein so as to penetrate from the one side face into the inner part through the passive film, wherein the recesses satisfy a relation of a ×tan 54.7 degrees≦d, where a is defined as a distance between the first recess and the second recess, and d is defined as a depth of the second recess, and forming the supply port by anisotropically etching the crystal from the one side face.

13 Claims, 9 Drawing Sheets

METHOD FOR MANUFACTURING LIQUID DISCHARGE HEAD

BACKGROUND OF THE INVENTION

1. Field of the Invention

The present invention relates to a substrate for a liquid discharge head, which is used for a liquid discharge head.

2. Description of the Related Art

An ink jet head for discharging an ink is known as a liquid discharge head for discharging a liquid.

The ink jet head employs a method of providing a through slot (ink supply port) in a substrate having a device for generating an ink discharge pressure formed thereon, and supplying an ink from a face in an opposite side of a face having the device for generating the ink discharge pressure formed thereon.

As for a method for forming the ink supply port of such an ink jet head, a method is disclosed which combines a technique for patterning a protection film with the use of a photolithographic process with an anisotropic etching technique. U.S. Pat. No. 6,143,190 discloses a method for forming a supply port by the steps of: forming a protection film on a rear surface of a silicon (100) substrate; removing the protection film at a portion for forming the ink supply port therein with the use of the photolithographic process; and anisotropically etching the silicon substrate in a strong alkaline solution. This method has an advantage that the dimension of the supply port can be set according to the application, because the method can determine the dimension of the supply port by changing the dimension of an opening of the protection film on the rear surface.

However, this type of a method for forming the ink supply port has a problem of needing an increased number of processes and having low production efficiency, because of opening the protection film with the use of the photolithographic process. When employing a thermal oxide film as the protection film, the method results in needing a plurality of processes such as a process of forming the thermal oxide film, a process of applying a resist on the thermal oxide film, a process of exposing and developing the resist, a process of removing the thermal oxide film with the use of a wet etching or dry etching technique and a process of removing the resist.

In order to cope with the problem, U.S. Pat. No. 6,563,079 discloses a method of preparing a supply port without using photolithography. This method forms a supply port by the steps of: forming a protection film on a silicon substrate; forming one hole (hereafter referred to as a laser hole) or a plurality of laser holes aligned in one row by irradiating a portion at which the supply port is formed, with a laser light from above the protection film; and spreading the laser holes with an anisotropic etching technique. The method can progress the anisotropic etching without removing the protection film with the use of the photolithographic process, because an etchant invades into the silicon substrate from the laser hole. However, according to the method, the dimension of the removed protection film becomes approximately the same as the dimension of the laser hole, and accordingly the supply port formed after having been anisotropically etched results in acquiring approximately the same width of the opening on the rear surface of the silicon substrate as the dimension of the laser hole. Therefore, the method cannot form the supply port having a desired dimension, which is different from a process that is described in U.S. Pat. No. 6,143,190 and uses the photolithography. It is possible to increase the dimension of the supply port by enlarging the laser hole. However, when a hole is formed by using the laser, generally, as the spot size is increased, energy density per unit area decreases and machining capacity decreases. Therefore, the method may cause problems that a tact time for the machining increases, the hole occasionally cannot be dug on the way, and a machined shape is deformed in some cases.

However, it has been difficult in a conventional method for manufacturing an ink supply port of an ink jet head to form the ink supply port having high reliability in supplying an ink without increasing the number of processes.

SUMMARY OF THE INVENTION

For this reason, the present invention is directed at solving the problem in a conventional method for forming an ink supply port of an ink jet head, and provides a method for forming the ink supply port having high reliability in supplying an ink, without needing complicated processes.

One example of the present invention is a method for manufacturing a substrate for a liquid discharge head having a silicon substrate provided with a supply port of a liquid including: preparing a substrate which is provided with a passive film on one side face thereof, has a first recess and a second recess provided therein so as to penetrate from the one side face into an inner part through the passive film, wherein the recesses satisfy a relation of $a \times \tan 54.7 \text{ degrees} \leqq d$, when a is defined as a distance between the first recess and the second recess, and d is defined as a depth of the second recess; and forming the supply port by anisotropically etching the crystal from the one side face.

According to the present invention, the ink supply port having high reliability in supplying the ink can be formed without passing through the complicated processes.

Further features of the present invention will become apparent from the following description of exemplary embodiments with reference to the attached drawings.

DESCRIPTION OF THE EMBODIMENTS

Figure 1:
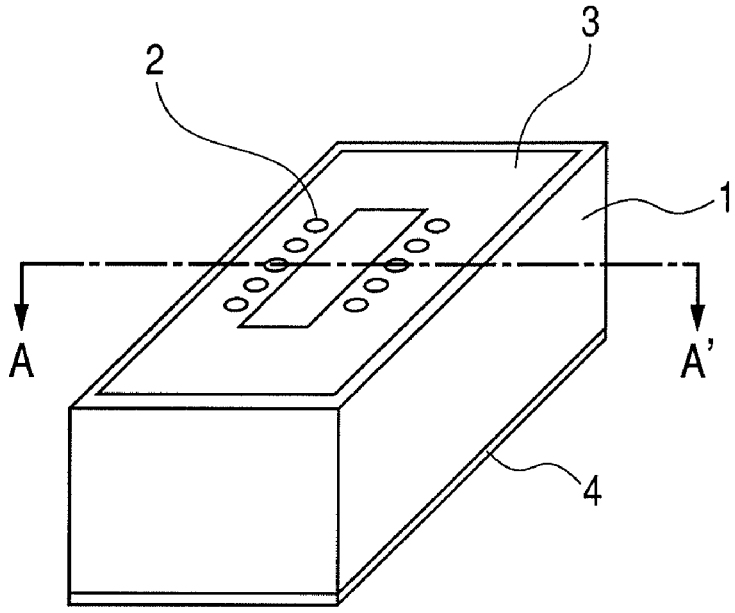
FIG. 1 is a perspective view of a base part of a substrate for an ink jet head according to Embodiment 1 of the present invention.

The embodiments according to the present invention will now be described below with reference to the drawings. In the following description, the same reference numerals will be given to a structure having the same function in the drawings, and the description will be omitted in some cases.

The exemplary embodiment of the present invention will be described below with reference to the drawings. In the following description, a substrate for a liquid discharge head will be described below while a substrate for an ink jet head, which is used in the ink jet head, is taken as an example thereof.

(Embodiment 1)

A method for manufacturing a substrate for the ink jet head of the present embodiment will now be described below with reference to FIG. 1 to FIG. 5.

Figure 2:
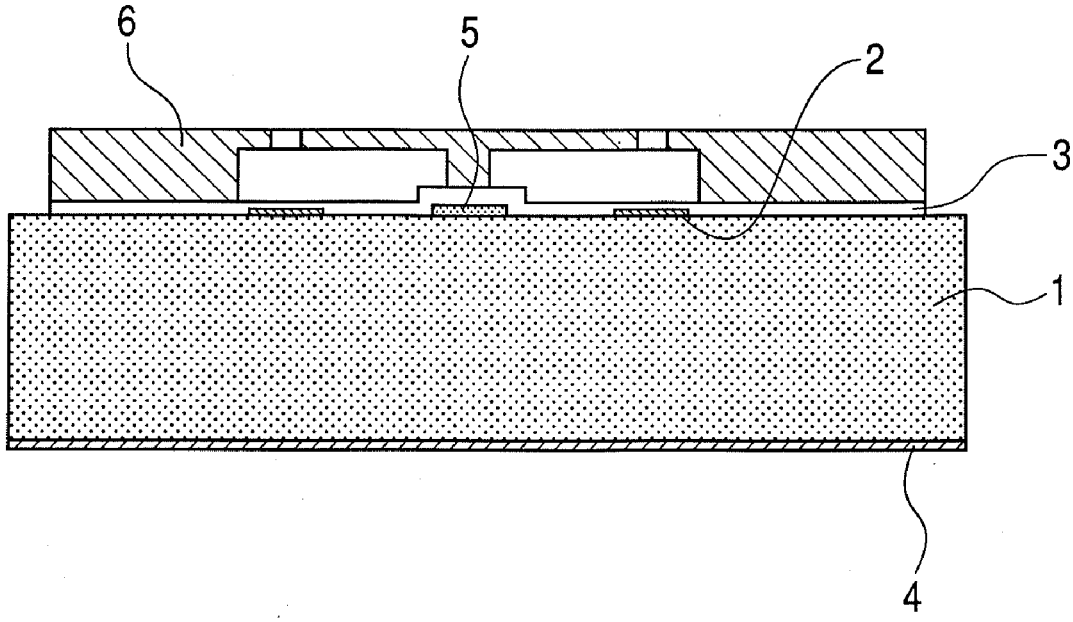
FIG. 2 is a cross sectional view illustrating a configuration of a substrate for an ink jet head in which an ink supply port is not yet formed, in Embodiment 1 according to the present invention.

FIG. 1 illustrates a perspective view of a substrate for an ink jet head according to the present embodiment, and FIG. 2 illustrates a perspective view of the ink jet head in a form of a cross section similar to a cross section taken along the line A-A' in FIG. 1.

As is illustrated in FIG. 1, electric wires (not shown) made from Al or the like and a plurality of ink-discharging-energy generation devices 2 (discharging-energy generation portions) made from a high-resistivity material such as TaSiN and TaN are arrayed so as to form two rows on one side face (surface) of a silicon substrate 1 (substrate for discharging liquid). An insulative protection film 3 made from SiO, SiN or the like is formed so as to cover the upper part thereof. This insulative protection film 3 protects a wiring structure on the substrate from ink and other liquids, and also plays a role as an etching stop layer when forming an ink supply port. Furthermore, a protection film 4 is formed on a second surface (rear side) in a reverse side of a first surface on which the insulative protection film 3 has been formed. At least one layer is formed as the protection film 4 on the substrate, and any material may be employed for the protection film 4, as long as the material shows passivation functions against an anisotropic etching liquid. The protection film 4 may be, for instance, any one layer of an insulation film made from SiO or the like, a metal film made from Mo, Au, TiN/Ti or the like, an inorganic film and an organic film, or may also be a combined layer of two or more layers. When employing a film of thermal oxide SiO, the protection film 4 can be formed simultaneously with the insulative protection film 3 on the front surface, but is not limited to the film of the thermal oxide SiO. When employing SiO, the protection film 4 includes a natural oxide film as well.

A sacrificial layer 5 made from a material which is etched at a higher rate than silicon is provided on the surface of the silicon substrate 1, before the insulative protection film 3 is formed, as is illustrated in FIG. 2. This sacrificial layer 5 is a layer for specifying the opening width of a through hole of the ink supply port in an anisotropic etching step which will be described later. At this time, it is efficient to select Al as a material for the sacrificial layer, because the sacrificial layer can be prepared simultaneously when a wiring-stacked structure of the ink jet head is formed.

An organic film layer 6 is stacked on the upper part of the insulative protection film 3 with the use of photolithography, and an ink flow path and a discharge port portion are formed therein.

Figure 3A:
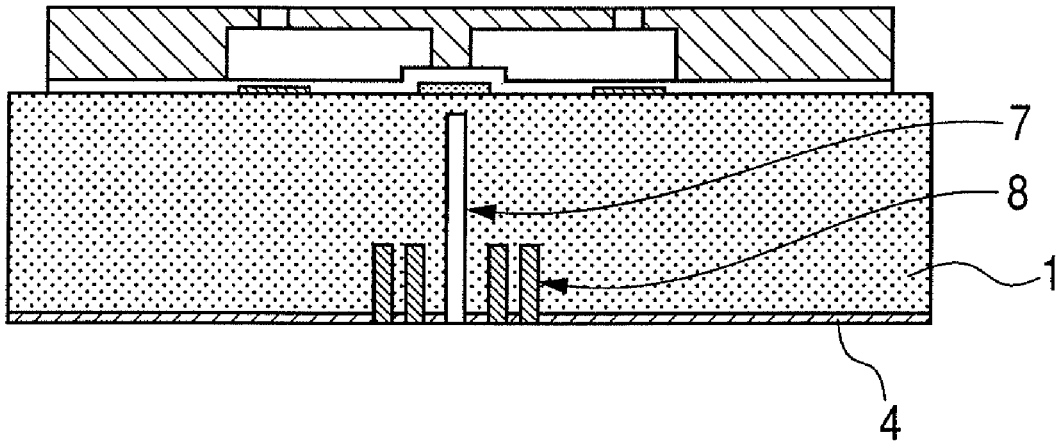
FIG. 3A is a sectional view in a state in which a recess has been formed in Embodiment 1.
Figure 3B:
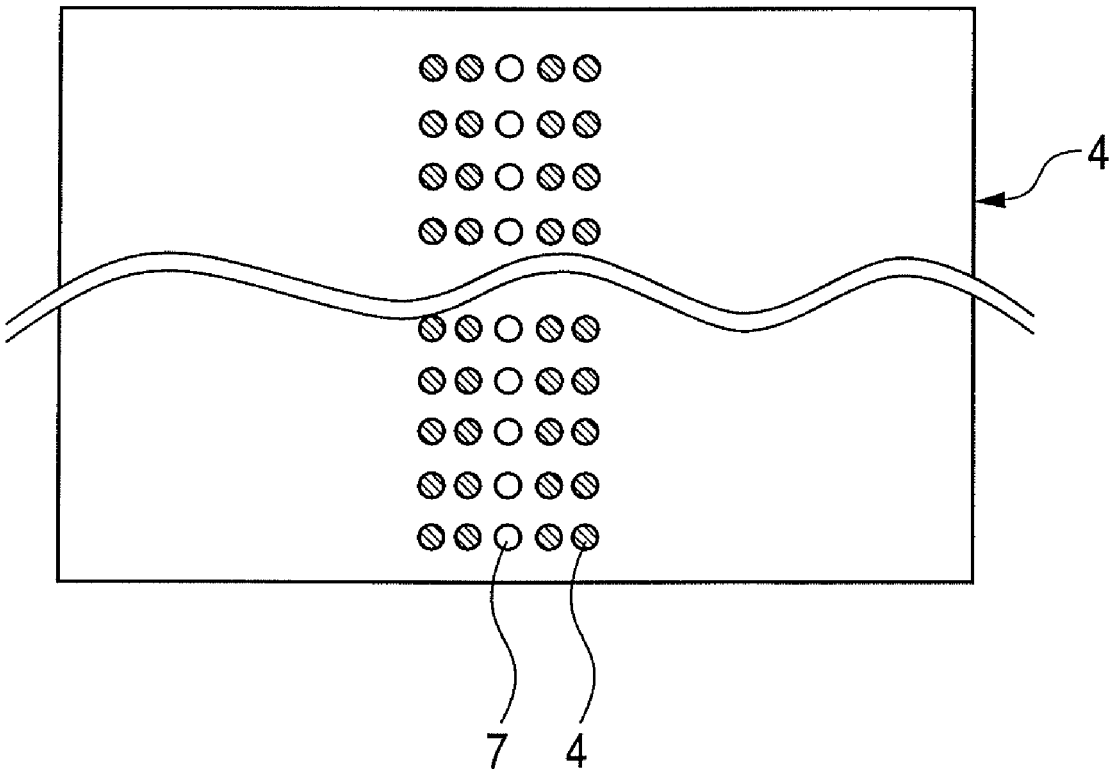
FIG. 3B is a rear surface view in the state.

Subsequently, a first recess 7 is formed from the rear side of the silicon substrate 1, as is illustrated in FIGS. 3A and 3B. Here, FIG. 3A is a longitudinal sectional view of the silicon substrate 1, and FIG. 3B is a plan view of the rear side of the silicon substrate 1. As is illustrated in the figures, the first recess 7 is formed so as to penetrate through the protection film 4 and stop in the inner part of the silicon substrate 1, when viewed from a portion on which an ink supply port is formed. A plurality of the first recesses are formed in a longitudinal direction of the substrate which is illustrated in FIG. 1, while forming one row in a transverse direction. In addition, a second recess 8 is formed at a position in the relatively outside of the row of the first recess 7. The second recess 8 is also formed so as to penetrate through the protection film 4 and stop in the inner part of the silicon substrate 1. A plurality of the second recesses are formed in a longitudinal direction of the substrate which is illustrated in FIG. 1, while forming one or more rows in a transverse direction. The second recess 8 is formed along an orientation of [001] or [110], or an orientation equal to them, on a (100) substrate 1.

Figure 12A:
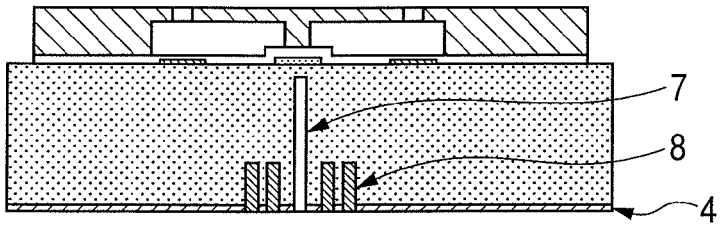
FIG. 12A is a sectional view illustrating another state in which a recess has been formed.
Figure 12B:
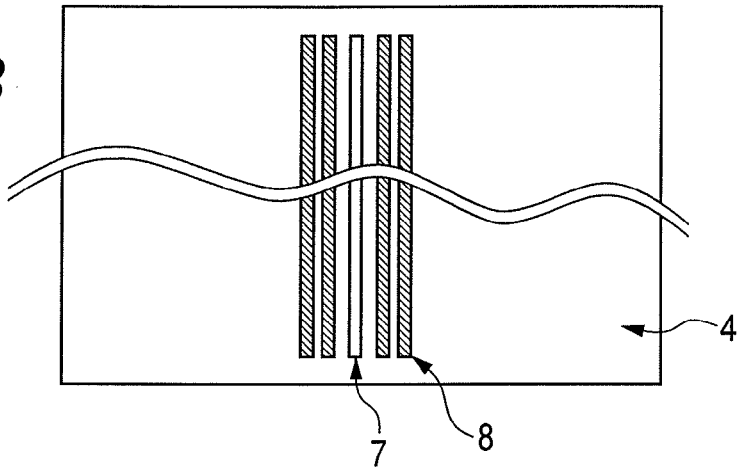
FIG. 12B is a rear surface view in the state.
Figure 13A:
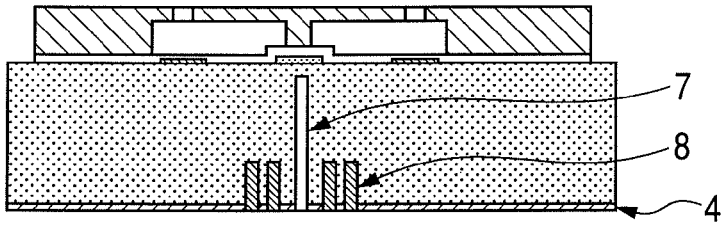
FIG. 13A is a sectional view illustrating another state in which a recess has been formed.
Figure 13B:
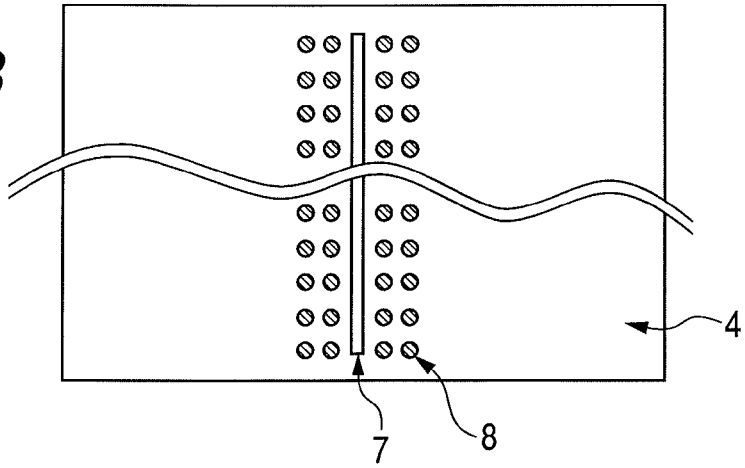
FIG. 13B is a rear surface view in the state.
Figure 14A:
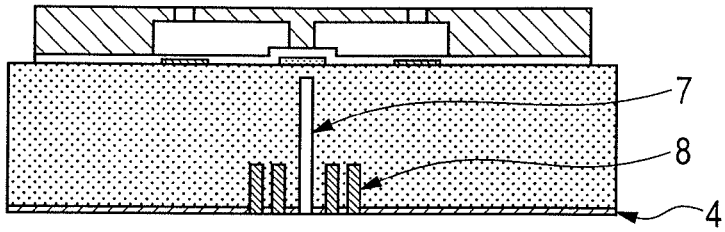
FIG. 14A is a sectional view illustrating another state in which a recess has been formed.
Figure 14B:
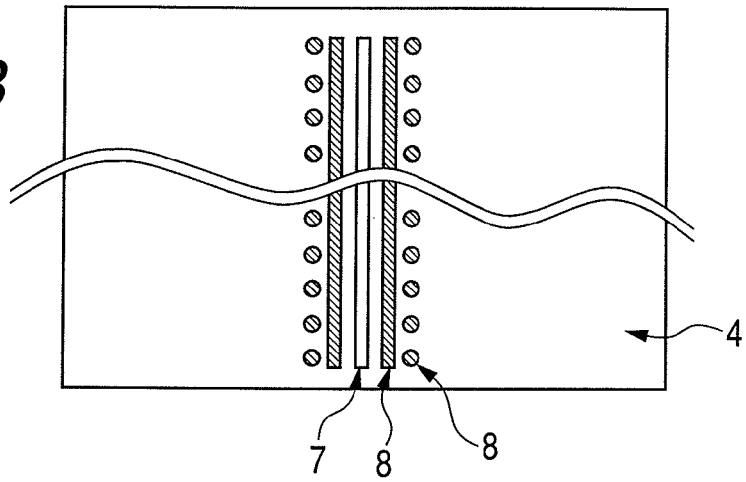
FIG. 14B is a rear surface view in the state.
Figure 15A:
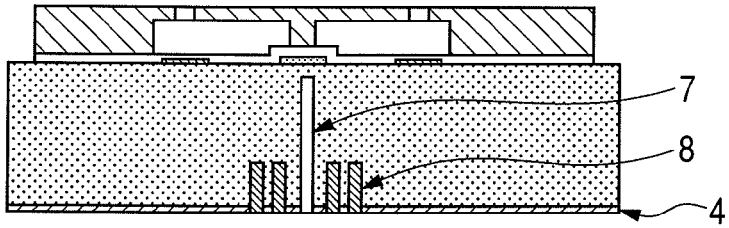
FIG. 15A is a sectional view illustrating another state in which a recess has been formed.
Figure 15B:
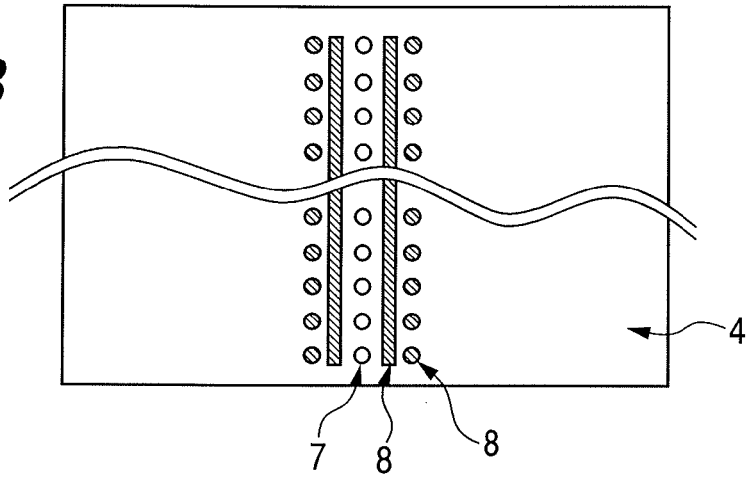
FIG. 15B is a rear surface view in the state.

In the present embodiment, the first recess 7 and the second recess 8 are formed into a conical shape having the bottom of a circle or an ellipse or into a columnar shape or into a cuboid shape having the bottom of a rectangle. However, a plurality of the first recesses 7 and second recesses 8, which are arrayed into a row, may partially or wholly have a trench shape, as is illustrated in FIGS. 12A and 12B to FIGS. 15A and 15B. FIGS. 12A and 12B show that the first recesses 7 and second recesses 8 formed into a cuboid groove are arranged parallel to each other. FIGS. 13A and 13B show that the second recesses 8 formed into columnar shape are arranged along the first recesses 7 formed into cuboid shape. FIGS. 14A and 14B show that the first recesses 7 are formed into cuboid shape, some of the second recesses 8 are formed into cuboid shape as the first recess 7 and others of the second recesses 8 are formed into columnar shape. FIGS. 15A and 15B show that the first recesses 7 comprise a plurality of columns which are arrayed into a row, some of the second recesses 8 are formed into cuboid shape and others of the second recesses 8 are formed into columnar shape as the first recesses 7.

The first recess 7 and the second recess 8 are formed with the use of a laser light. A pore having approximately the same diameter as the laser spot is formed in the silicon substrate by irradiating a portion on which a recess is to be formed with a laser light from above the protection film 4, and thereby removing the protection film 4 and silicon. The depths of the first recess 7 and the second recess 8 to be machined are specified by a type of a laser, an output condition of the laser, a spot diameter of the laser, a hole diameter to be machined, and the number of the pulse. The depth of the recess was 530 μm, for instance, when having employed a triple-multiplied wave of a YAG laser having high absorptivity to the silicon as a type of laser, and having machined the recess on an output condition of 5.5 W, at a frequency of 30 kHz, with a spot diameter of 25 μm and a machined hole diameter of 25 μm, and in the pulse number of 30 times. As for the type of the laser, a fundamental wave, a double-multiplied wave, a triple-multiplied wave or a quadruple-multiplied wave of the YAG laser and a $YVO_4$ laser, or another laser may be employed. The first recess 7 and the second recess 8 can be machined in the same process with the use of the same laser apparatus, at the same time, for simplification of the process. However, different laser apparatuses may be used in some cases. In addition, the second recess 8 may be formed prior to the first recess 7. It is also allowed to give the first recess 7 and the second recess 8 larger machined diameters than the diameter of the laser spot, by trepan-machining the silicon substrate while scanning the laser spot in a spiral shape.

Figure 4A:
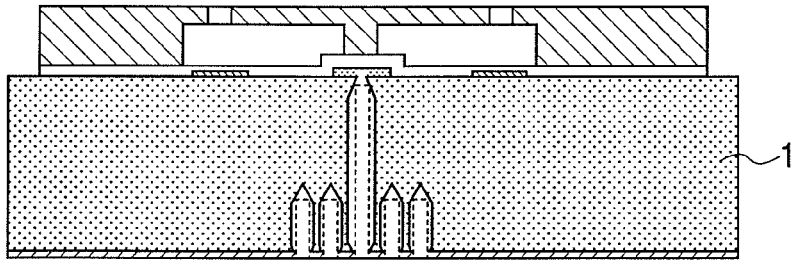
FIGS. 4A, 4B, 4C, 4D and 4E are schematic process views illustrating a progression state of anisotropic etching according to Embodiment 1.
Figure 4B:
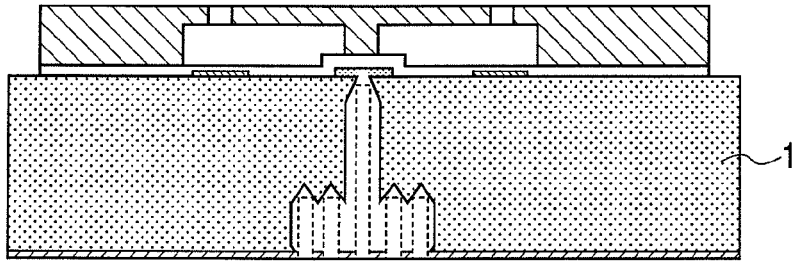
Figure 4C:
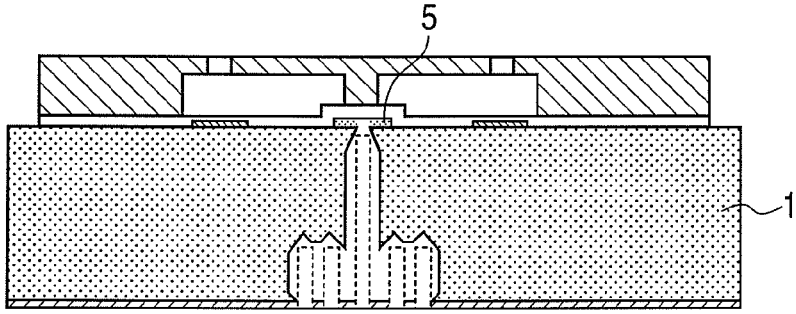
Figure 4D:
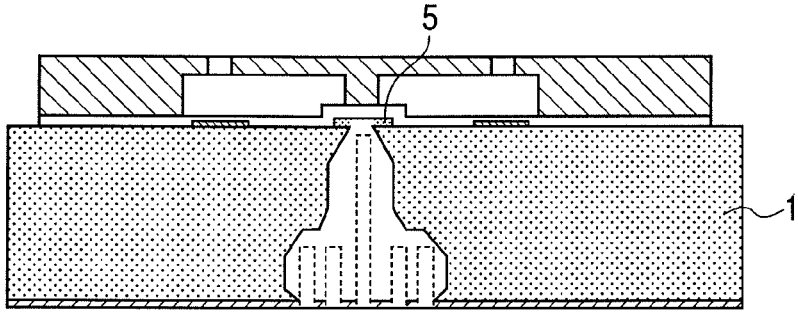
Figure 4E:
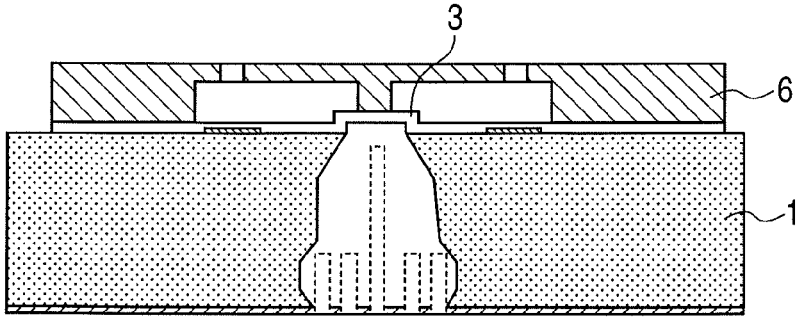
Figure 5:
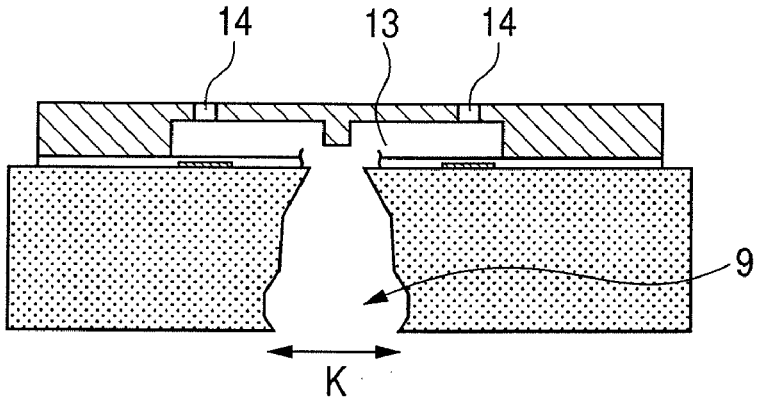
FIG. 5 is a schematic sectional view illustrating an ink supply port which has been formed through a manufacturing process according to Embodiment 1 of the present invention.

Subsequently, the silicon substrate 1 is immersed in a TMAH solution, and is anisotropically etched. In this treatment, an etching reaction starts from all wall faces of the recesses 7 and 8, and progresses while forming a (111) face, having a low etching rate in some place, or along a (001) face, a (011) face or another face all having a high etching rate, in some place. FIGS. 4A, 4B, 4C, 4D and 4E schematically illustrate a progression process of etching. The dotted lines in the figures denote positions on which the first recess 7 and the second recess 8 have been formed, as is illustrated in FIG. 3A. The etching reaction progresses in a direction perpendicular to the thickness of the silicon substrate 1 (FIG. 4A), while the (111) face from each of the top and the bottom part of the recess is formed. After a predetermined time, the recesses are communicated with each other through a space between the recesses (FIG. 4B). At this time, in the vicinity of the top of the recess, the (111) faces are connected with each other to form a salient. At the same time, in the vicinity of the bottom part of the recess as well, the (111) faces are connected with each other to form a salient. The salient has a high etching rate because the salient is made of a higher order of a face, so that the etching reaction progresses in a thickness direction [100] of the silicon substrate 1 (FIG. 4C and FIG. 4D). When a predetermined time has passed, the surface of the silicon substrate 1 is opened having the same dimension as the width of the sacrificial layer 5, and a slot penetrating through the silicon substrate 1 is completed (FIG. 4E). Subsequently, the silicon substrate 1 is subjected to a wet process and a dry etching process sequentially, and the protection film 4 on the rear surface of the silicon substrate 1, the insulative protection film 3 on the front surface of the silicon substrate 1, and a part of the organic film layer 6 are removed. Thereby, an ink supply port 9 is completed which communicates an ink flow path 13 in the front surface side of the silicon substrate 1 and a nozzle 14 (liquid discharge port) with an opening on the rear surface of the silicon substrate 1, as is illustrated in FIG. 5.

The manufacturing method according to the present embodiment can control the dimension K of the opening on the rear surface of the silicon substrate 1, by forming a second recess 8 on a predetermined condition. A condition for forming the second recess will now be described below in detail.

Figure 6:
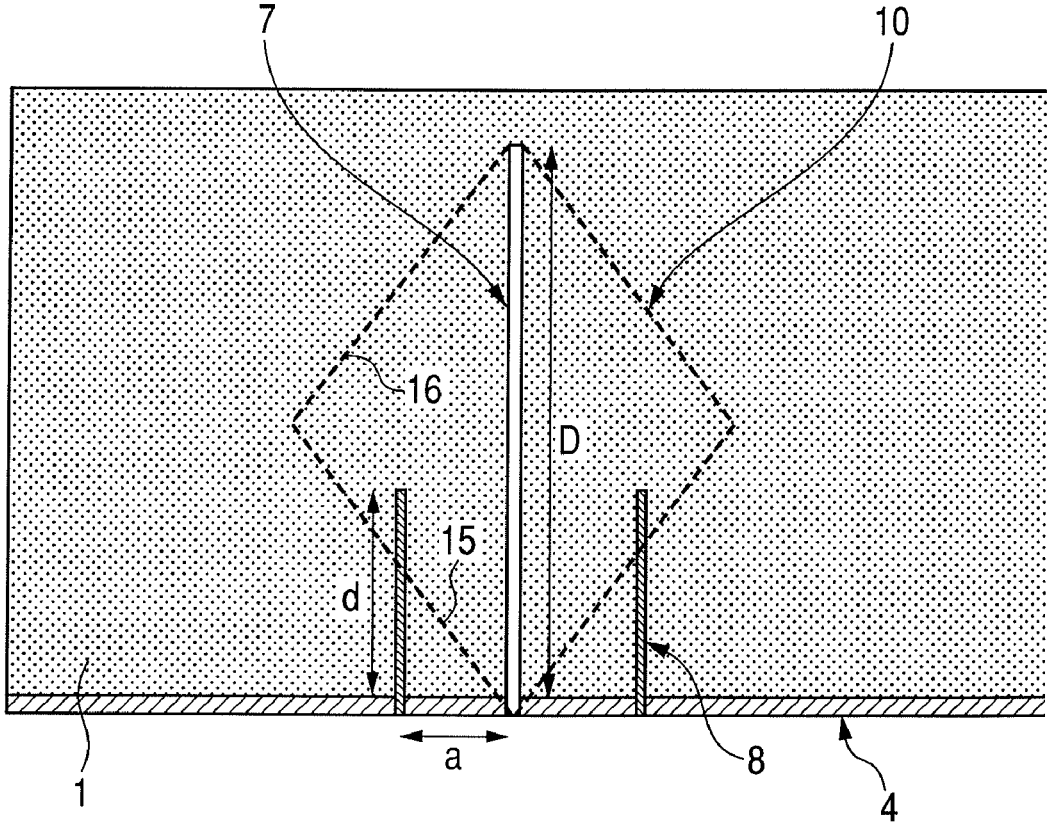
FIG. 6 is a schematic sectional view for describing a condition for forming a recess in Embodiment 1.

FIG. 6 schematically illustrates the condition for forming the recess.

At first, focus attention on an etched shape to be formed only by a first recess 7. An anisotropic etching reaction starts from the bottom part and the top part of the first recess 7 to form (111) faces 15 and 16, which have a low etching rate, and finally completes a rhombically etched shape 10 (illustrated with dotted line in FIG. 6). In this process, an etching reaction in a direction perpendicular to the thickness of the substrate 1 almost does not progress apparently at the bottom part of the recess 7, so that the dimension of the opening on the rear surface of the substrate 1 is hardly widened.

Next, consider the case where the second recess 8 is formed at a distance a beside the first recess 7. When a depth d of the second recess 8 satisfies a relation of $$a \times \tan 54.7 \text{ degrees} \leqq d,$$

the top of the second recess 8 results in existing at a position deeper than the (111) face 15, when viewed from the rear surface of the silicon substrate. Suppose the silicon substrate is anisotropically etched when the laser holes are arranged in the above way. Then, the etched shape formed by the first recess 7 merges with the etched shape formed by the second recess 8 in a predetermined period of time, which results in making a space between the recesses communicated, as is illustrated in FIG. 4. Accordingly, the dimension K of the supply port on the rear surface of the silicon substrate 1 can be set by changing the distance a between the first recess 7 and the second recess 8, and the depth d of the second recess 8.

Figure 7:
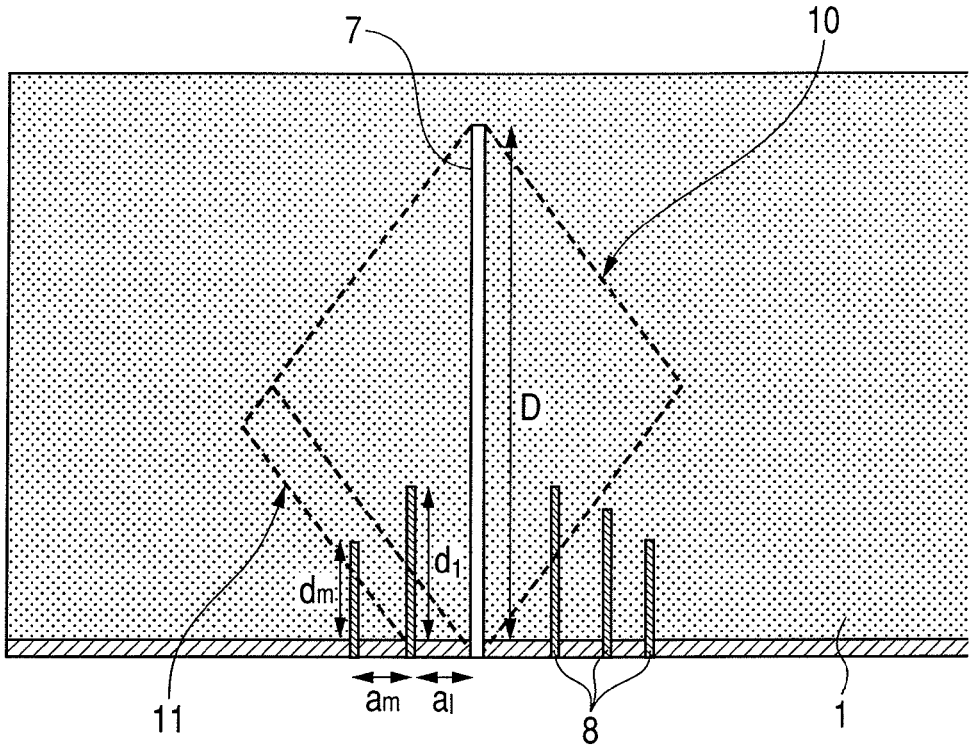
FIG. 7 is a schematic sectional view for describing a condition for forming a recess in Embodiment 1.

In a configuration of FIG. 6, the supply port on the rear surface of the silicon substrate 1 can be formed so as to acquire a wider width of the opening (FIG. 7), by forming the second recess 8 into n rows ($n \geqq 2$). The same way of thinking as described above can be applied to this case as well. Accordingly, each of the second recesses 8 may be formed at a position deeper than the (111) face 11 of an adjacent recess, as is illustrated in FIG. 7. The specific content will now be described below.

Suppose that the depth of the second recess 8 at an (m)th row ($2 \leqq m \leqq n$) toward the outside from the row formed by a plurality of the first recesses 7 is $d_m$, and a distance between an (m−1)th row and the (m)th row is $a_m$. Suppose that each depth of the second recesses 8 of the first row is $d_1$, and the distance between the second recess 8 and the first recess 7 is $a_1$. In this case, the second recess 8 may be formed so as to satisfy the relations of $$a_1 \times \tan 54.7 \text{ degrees} \leqq d_1 \text{ and}$$

$$a_m \times \tan 54.7 \text{ degrees} \leqq d_m.$$

In this way, the method for manufacturing a substrate for an ink jet head in the present embodiment can form a supply port 9 having various dimensions of openings on the rear surface, by changing an arrangement and output condition of a laser light. Accordingly, the manufacturing method can provide a substrate for an ink jet head having an improved reliability of bubble ejection, while shortening the process.

(Embodiment 2)

A method for manufacturing a substrate for an ink jet head in the present embodiment will now be described below.

At first, electric wires (not shown) made from Al or the like and a plurality of ink-discharging-energy generation devices 2 (discharging-energy generation portions) made from a high-resistivity material such as TaSiN and TaN are arrayed so as to form two rows on one side face (surface) of a silicon substrate 1 (substrate for discharging liquid), as is illustrated in FIG. 1. An insulative protection film 3 made from SiO, SiN or the like is formed so as to cover the upper part thereof. Furthermore, a protection film 4 is formed on a second surface (rear side) in a reverse side of a first surface on which the insulative protection film 3 has been formed. A sacrificial layer 5 is provided on the surface of the silicon substrate 1, before the insulative protection film 3 is formed as is illustrated in FIG. 2. For the insulative protection film 3 and the sacrificial layer 5, the same materials as in Embodiment 1 are used.

An organic film layer 6 is stacked on the upper part of the insulative protection film 3 with the use of photolithography, and an ink flow path and a discharge port portion are formed therein.

Figure 8A:
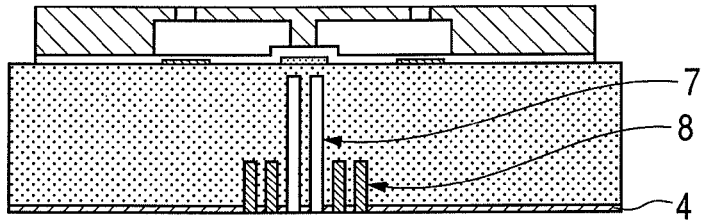
FIG. 8A is a sectional view in a state in which a recess has been formed in Embodiment 2.
Figure 8B:
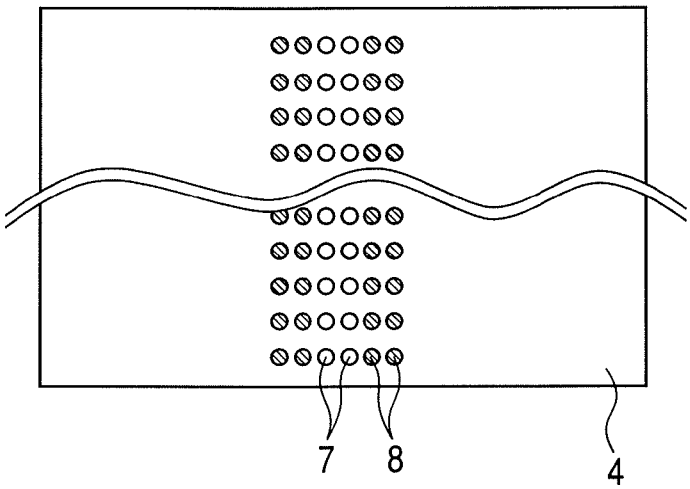
FIG. 8B is a rear surface view in the state.

Subsequently, a first recess 7 is formed from the rear side of the silicon substrate 1, as is illustrated in FIGS. 8A and 8B. Here, FIG. 8A is a longitudinal sectional view of the silicon substrate 1, and FIG. 8B is a plan view illustrating the rear side of the silicon substrate 1. As is illustrated in these figures, the first recess 7 is formed so as to penetrate through the protection film 4 and stop in the inner part of the silicon substrate 1 when viewed from a portion on which an ink supply port is formed. A plurality of the first recesses are formed in a longitudinal direction of the substrate which is illustrated in FIG. 1, while forming two or more rows in a transverse direction. In addition, a second recess 8 is formed at a position in the relatively outside of the rows of the first recess 7. The second recess 8 is also formed so as to penetrate through the protection film 4 and stop in the inner part of the silicon substrate 1. A plurality of the second recesses are formed in a longitudinal direction of the substrate which is illustrated in FIG. 1, while forming one or more rows in a transverse direction. The second recess 8 is formed along an orientation of [001] or [110], or an orientation equal to them, on a (100) substrate 1.

In the present embodiment, the first recess 7 and the second recess 8 are formed into a conical shape with the bottom of a circle or an ellipse, or a columnar shape. However, the first recess 7 and the second recess 8 which form rows by a plurality of aligned recesses may be partially or wholly formed into a trench shape, as is illustrated in FIGS. 12A and 12B to FIGS. 15A and 15B.

The first recess 7 and the second recess 8 are formed with the use of a laser light. A pore having approximately the same diameter as the laser spot is formed in the silicon substrate by irradiating a portion on which a recess is to be formed with the laser light from above the protection film 4, and thereby removing the protection film 4 and silicon. The depths of the first recess 7 and the second recess 8 to be machined are specified by a type of a laser, an output condition of the laser, a spot diameter of the laser, a hole diameter to be machined, and the number of the pulses. For instance, the depth of the recess was 530 μm when a triple-multiplied wave of a YAG laser having high absorptivity to the silicon was used as a type of a laser, and the recess was machined on an output condition of 5.5 W, at a frequency of 30 kHz, with a spot diameter of 25 μm and a machined hole diameter of 25 μm, and in the pulse number of 30 times. As for the type of the laser, a fundamental wave, a double-multiplied wave, a triple-multiplied wave or a quadruple-multiplied wave of the YAG laser and a $YVO_4$ laser, or another laser may be employed. The first recess 7 and the second recess 8 can be machined in the same process with the use of the same laser apparatus, at the same time, for simplification of the process. However, different laser apparatuses may be used in some cases. In addition, the second recess 8 may be formed prior to the first recess 7. It is also allowed to give the first recess 7 and the second recess 8 larger machined diameters than that of the laser spot, by trepan-machining the silicon substrate while scanning the laser spot in a spiral shape.

Figure 9A:
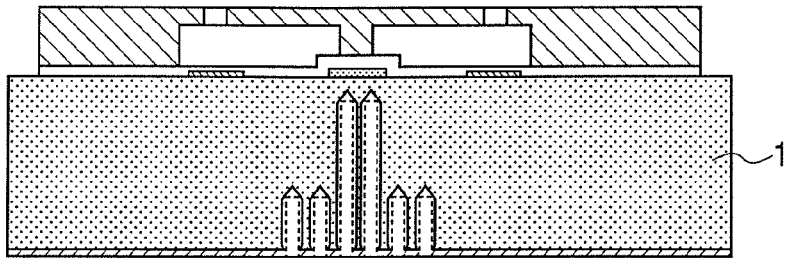
FIGS. 9A, 9B, 9C, 9D and 9E are schematic process views illustrating a progression state of anisotropic etching in Embodiment 2.
Figure 9B:
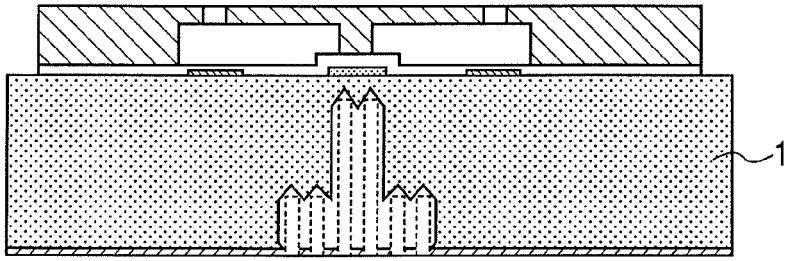
Figure 9C:
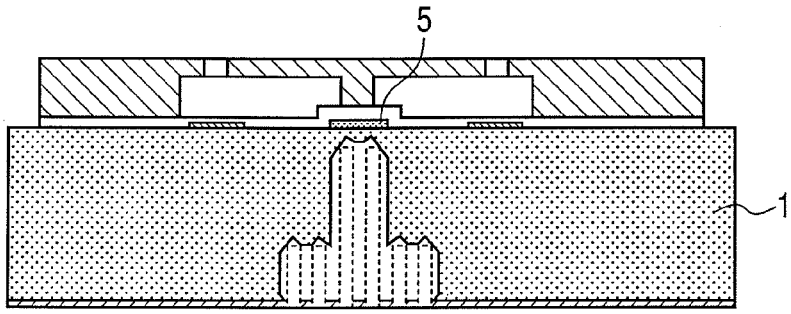
Figure 9D:
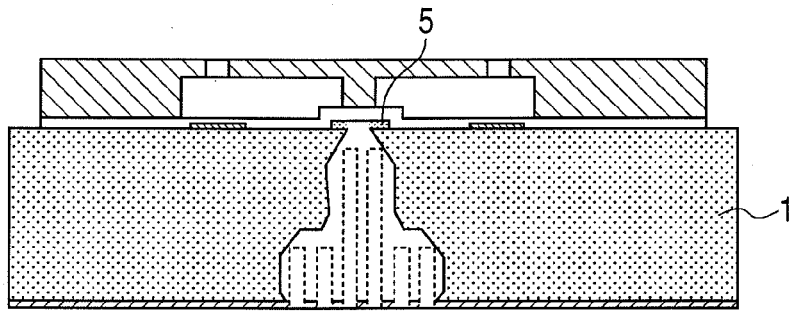
Figure 9E:
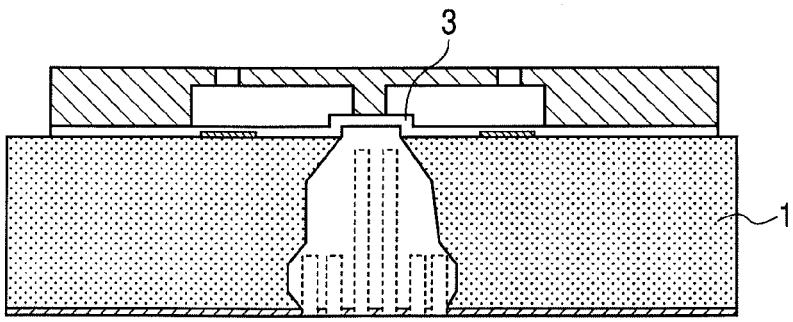

Subsequently, the silicon substrate is immersed in a TMAH solution, and is anisotropically etched. In this treatment, an etching reaction starts from all wall faces of the recesses, and progresses while forming a (111) face having a low etching rate in some place, or along a (001) face or a (011) face both having a high etching rate or another face in some place. FIGS. 9A, 9B, 9C, 9D and 9E schematically illustrate a progression process of etching. The etching reaction progresses in a direction perpendicular to the thickness T of the silicon substrate 1 (FIG. 9A), while forming the (111) face from each of the top and the bottom part of the recess. After a predetermined time, the recesses are communicated with each other through a space between the recesses (FIG. 9B). At this time, in the vicinity of the top and the bottom part of the recess, the (111) faces are connected with each other to form salients. The salient has a high etching rate because the salient is made of a higher order of a face, so that the etching reaction results in progressing in a [100] direction which is a thickness direction of the silicon substrate 1, after the time (FIGS. 9C and 9D). When a predetermined time has passed, the surface of the silicon substrate 1 is opened so as to have the same dimension as the width of the sacrificial layer 5, and a slot penetrating through the silicon substrate 1 is completed (FIG. 9E). Subsequently, the silicon substrate 1 is subjected to a wet process and a dry etching process sequentially, and the protection film 4 on the rear surface of the silicon substrate 1, the insulative protection film 3 on the front surface of the silicon substrate 1 and a part of the organic film layer 6 are removed. Thereby, an ink supply port 9 is completed which communicates an ink flow path 13 in the front surface side of the silicon substrate 1 and a nozzle 14 (liquid discharge port) with an opening on the rear surface of the silicon substrate 1, as is illustrated in FIG. 5.

The manufacturing method according to the present embodiment can control the dimension of the opening on the rear surface of the silicon substrate, by forming the second recess 8 on a predetermined condition. A condition for forming the second recess 8 will now be described below in detail.

Figure 10:
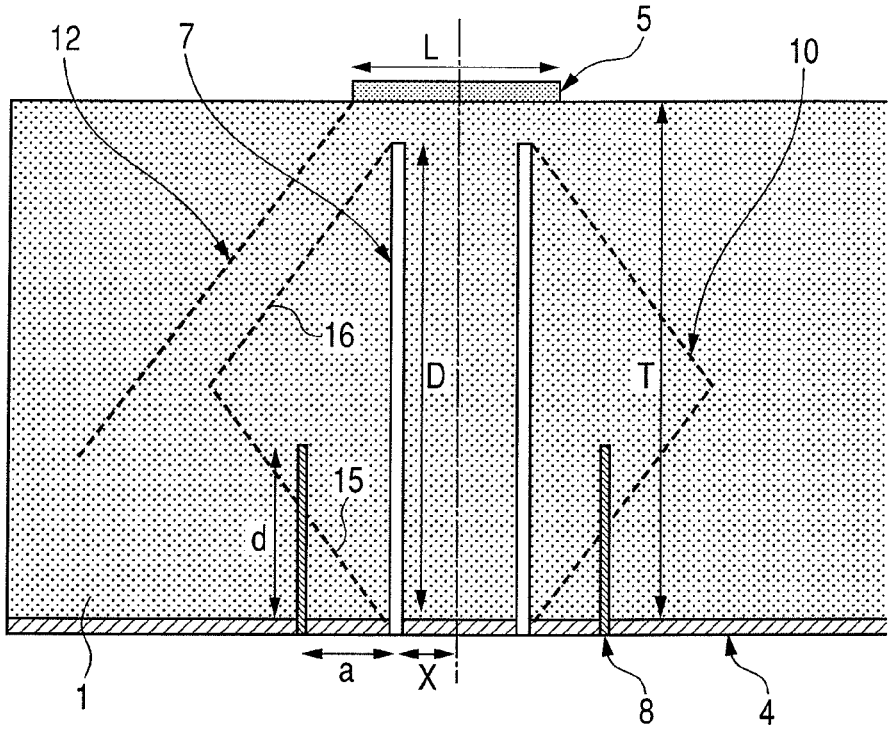
FIG. 10 is a schematic sectional view for describing a condition for forming a recess in Embodiment 2.

FIG. 10 schematically illustrates the condition for forming the recess. Suppose that D is defined as a depth of the first recess 7, d is defined as a depth of the second recess 8, and a is defined as a distance between an adjacent row of the first recess 7 and a row of the second recess 8. Suppose that L is defined as a width of a sacrificial layer, and X is defined as a distance between the first recess 7 in the most outer side and the center of the sacrificial layer 5.

At first, focus attention on an etched shape to be formed only by the first recess 7. An anisotropic etching reaction starts from the bottom part and the top part of the first recess 7 to form (111) faces 15 and 16, which have a low etching rate, and finally completes an etched shape 10 of which the external side is covered with the (111) faces. In this process, an etching reaction in a direction perpendicular to the thickness T of the silicon substrate 1 almost does not progress apparently at the bottom part of the recess 7, so that the dimension of the opening on the rear surface of the silicon substrate 1 is hardly widened.

Next, consider the case where the second recess 8 is formed at a distance of a beside the first recess 7. When a depth d of the second recess 8 satisfies the relation of $$a \times \tan 54.7 \text{ degrees} \leqq d,$$

the top of the second recess 8 results in existing at a position deeper than the (111) face 15, when viewed from the rear surface of the silicon substrate. Suppose that the silicon substrate is anisotropically etched when the laser holes are arranged in the above way. Then, the etched shape formed by the first recess 7 merges with the etched shape formed by the second recess 8 in a predetermined period of time, which results in making a space between the recesses communicated, as is illustrated in FIGS. 9A to 9E. Accordingly, the dimension K of the supply port on the rear surface of the silicon substrate 1 can be set by changing the distance a between the first recess 7 and the second recess 8, and the depth d of the second recess 8.

In addition, in order to form an opening on the surface of the silicon substrate 1 into the width L of the sacrificial layer 5, the first recess 7 needs to be formed so as to satisfy a range of the following relational expressions:

$$T-(X-L/2)\times\tan 54.7\text{ degrees}\geqq D\geqq T-X\times\tan 54.7\text{ degrees},$$

in the case of X≧L/2; and $$T>D\geqq T-X\times\tan 54.7\text{ degrees},$$

in the case of X<L/2.

In the above described two expressions, the right inequality expression is a conditional expression which is required so that the anisotropically etched part reaches the sacrificial layer on the surface of the silicon substrate, and the left inequality expression is a conditional expression necessary for the dimension of the opening on the surface of the silicon substrate formed by the anisotropic etching process to be controlled into the width L of the sacrificial layer, that is, a conditional expression necessary for a (111) face formed by etching to be formed within a region inside a (111) face 12 reaching to an end of the sacrificial layer.

Furthermore, in order that the dimension of the opening on the surface of the silicon substrate, which is formed through the anisotropic etching process, is controlled into the width L of the sacrificial layer, the parameters need to satisfy the following expressions for the second recess 8 as well:

$$a+X\leqq T/\tan 54.7\text{ degrees}+L/2,\text{ and}$$

$$d\leqq T-(a+X-L/2)\times\tan 54.7\text{ degrees}.$$

The above two inequality expressions are an expression relating to an arrangement of the second recess 8 in the substrate, and an expression relating to the depth thereof, respectively.

Figure 11:
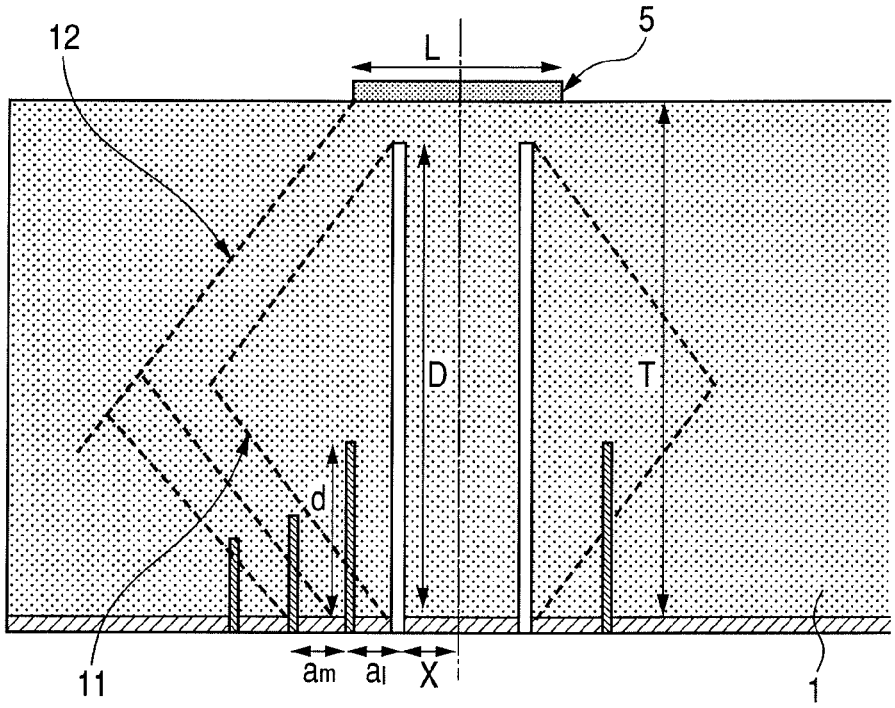
FIG. 11 is a schematic sectional view for describing a condition for forming a recess in Embodiment 2.

In a configuration of FIG. 10, the supply port on the rear surface of the silicon substrate 1 can be formed so as to acquire a wider width of the opening (FIG. 11), by forming the second recess 8 into n rows (n≧2). The same way of thinking as described above can be applied to this case as well. Here, suppose that the depth of the second recess 8 at an (m)th row (2≦m≦n) toward the outside from the row formed by a plurality of the first recesses 7 is $d_m$, and a distance between an (m−1)th row and the (m)th row is $a_n$. Suppose that the distance between the first row of the second recess 8 and the row of the first recess 7 is $a_1$, a depth of the second recesses 8 in the first row is $d_1$. Suppose that a width of a sacrificial layer 5 is L and a distance between the first recess 7 in the most outer side and the center of the sacrificial layer 5 is X.

The conditions to be satisfied by the first recess and the second recess are shown by the following expressions:

$$T-(X-L/2)\times\tan 54.7\text{ degrees}\geqq D\geqq T-X\times\tan 54.7\text{ degrees},$$

in the case of X≧L/2; and $$T>D\geqq T-X\times\tan 54.7\text{ degrees};$$

$$a_1+a_2+\ldots a_m+\ldots a_n+X\leqq T/\tan 54.7\text{ degrees}+L/2;$$

$$a_1\times\tan 54.7\text{ degrees}\leqq d_1\leqq T-(a_1+X-L/2)\times\tan 54.7\text{ degrees; and}$$

$$a_m\times\tan 54.7\text{ degrees}\leqq d_m\leqq T-(a_1+a_2+\ldots a_m+X-L/2)\times\tan 54.7\text{ degrees},$$

in the case of X<L/2.

In this way, the method for manufacturing a substrate for an ink jet head in the present embodiment can form a supply port 9 having various dimensions of openings on the rear surface, by changing an arrangement and output condition of a laser light. Accordingly, the manufacturing method can provide an ink jet head having an improved reliability of bubble discharge, while shortening the process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-231352, filed Sep. 6, 2007, which is hereby incorporated by reference herein in its entirety.

What is claimed is:

1. A method for manufacturing a substrate for a liquid discharge head having a silicon substrate provided with a supply port of a liquid, comprising:

preparing a substrate which is provided with a passive film on one side face thereof, has a first recess and a second recess provided therein so as to penetrate from the one side face into the inner part through the passive film, wherein the recesses satisfy a relation of a ×tan 54.7 degrees ≦d, where a is defined as a distance between the first recess and the second recess, and d is defined as a depth of the second recess; and forming the supply port by anisotropically etching the crystal from the one side face.

2. The method for manufacturing the substrate for the liquid discharge head having the silicon substrate provided with the supply port of the liquid according to claim 1, wherein the first recess and the second recess are formed with the use of a YAG or $YVO_4$ laser.

3. The method for manufacturing the substrate for the liquid discharge head having the silicon substrate provided with the supply port of the liquid according to claim 1, wherein the first recess and the second recess have a conical shape with the bottom of a circle or an ellipse or a columnar shape.

4. The method for manufacturing the substrate for the liquid discharge head having the silicon substrate provided with the supply port of the liquid according to claim 1, wherein the first recess is provided in a position which corresponds to substantially a center of the supply port to be formed in a transverse direction and is provided in plural so as to form a row along a longitudinal direction of a portion at which the supply port is formed, and the second recess is provided in plural so as to sandwich the first recess.

5. The method for manufacturing the substrate for the liquid discharge head having the silicon substrate provided with the supply port of the liquid according to claim 1, wherein the first recess forms a row so that a plurality of the first recesses are formed along a longitudinal direction of a portion at which the supply port is formed, and the row is provided so as to form one or more rows in a transverse direction of the portion at which the supply port is formed.

6. The method for manufacturing the substrate for the liquid discharge head having the silicon substrate provided with the supply port of the liquid according to claim 1, wherein the second recess forms a row so that a plurality of the second recesses are formed along a longitudinal direction of a portion at which the supply port is formed, and the row is provided so as to form one or more rows in a transverse direction of the portion at which the supply port is formed.

7. The method for manufacturing the substrate for the liquid discharge head having the silicon substrate provided with the supply port of the liquid according to claim 1, wherein the first recess and the second recess are provided in plural and satisfy the relation of $$a_1\times\tan 54.7\text{ degrees}\leqq d,$$

where the plurality of the first recesses are provided to form one row, the plurality of the second recesses are provided to form one row outside of the row of the first recesses, and $a_1$ is defined as a distance between the row of the first recesses and the row of the second recesses.

8. The method for manufacturing the substrate for the liquid discharge head having the silicon substrate provided with the supply port of the liquid according to claim 1, wherein the second recess is provided so as to satisfy the relations of $$a_1 \times \tan 54.7 \text{ degrees} \leqq d_1, \text{ and}$$

$$a_m \times \tan 54.7 \text{ degrees} \leqq d_m,$$

where a plurality of the first recesses are provided to form one row, a plurality of the second recesses are provided to form n rows ($n \geqq 2$) outside of the row formed of the first recesses, $d_m$ is defined as a depth of the second recess in an (m)th row ($2 \leqq m \leqq n$) from the row of the first recess toward the outside, $a_m$ is defined as a distance between an (m−1)th row and the (m)th row, $a_1$ is defined as a distance between the first row of the second recess and the row of the first recess, and $d_1$ is defined as a depth of the second recess in the first row.

9. The method for manufacturing the substrate for the liquid discharge head having the silicon substrate provided with the supply port of the liquid according to claim 1, wherein the passive film is formed by combining at least two films from any of an insulation film, a metal film, an inorganic film and an organic film, with each other.

10. The method for manufacturing the substrate for the liquid discharge head having the silicon substrate provided with the supply port of the liquid according to claim 1, further comprising a material layer that is etched at a higher rate than silicon, which is provided on the other face that is the rear surface of the one side face of the substrate before the substrate is etched anisotropically for the crystal.

11. The method for manufacturing the substrate for the liquid discharge head having the silicon substrate provided with the supply port of the liquid according to claim 10, wherein two or more rows formed of a plurality of the first recesses are provided; one row formed of a plurality of the second recesses is provided outside of the rows of the first recesses in the most outer side from the center of the material layer; and when $a_1$ is defined as a distance between the row of the first recesses in the most outer side and the row of the second recesses, D is defined as a depth of the first recess, L is defined as a width of the sacrificial layer, T is defined as a thickness of the substrate, and X is defined as a distance between the first recesses in the most outer side from the center of the sacrificial layer and the center of the sacrificial layer, the parameters satisfy the relational expression of $$T-(X-L/2) \times \tan 54.7 \text{ degrees} \geqq D \geqq T-X \times \tan 54.7 \text{ degrees, in the case of } X \geqq L/2,$$

satisfy the relational expression of $$T > D \geqq T-X \times \tan 54.7 \text{ degrees, in the case of } X < L/2, \text{ and}$$

satisfy the relational expressions of $$a_1+X \leqq T/\tan 54.7 \text{ degrees}+L/2, \text{ and}$$

$$a_1 \times \tan 54.7 \text{ degrees} \leqq d \leqq T-(a_1+X-L/2) \times \tan 54.7 \text{ degrees},$$

in both of the cases.

12. The method for manufacturing the substrate for the liquid discharge head having the silicon substrate provided with the supply port of the liquid according to claim 10, wherein two or more rows formed of a plurality of the first recesses are provided; n rows ($n \geqq 2$) formed of a plurality of the second recesses are provided outside of the rows of the first recesses in the most outer side from the center of the material layer; and where $d_m$ is defined as a depth of the second recesses in an (m)th row ($2 \leqq m \leqq n$) from the row of the first recesses in the most outside toward the outside, $a_m$ is defined as a distance between an (m−1)th row and the (m)th row, $a_1$ is defined as a distance between the first row of the second recesses and the row of the first recesses, $d_1$ is defined as a depth of the second recesses in the first row, D is defined as a depth of the first recesses, L is defined as a width of the sacrificial layer, T is defined as a thickness of the substrate, and X is defined as a distance between the first recesses in the most outer side from the center of the sacrificial layer and the center of the sacrificial layer, the parameters satisfy the relational expression of $$T-(X-L/2) \times \tan 54.7 \text{ degrees} \geqq D \geqq T-X \times \tan 54.7 \text{ degrees, in the case of } X \geqq L/2,$$

satisfy the relational expression of $$T > D \geqq T-X \times \tan 54.7 \text{ degrees, in the case of } X < L/2, \text{ and}$$

satisfy the relational expressions of $$a_1+a_2+\ldots a_m+\ldots a_n+X \leqq T/\tan 54.7 \text{ degrees}+L/2,$$

$$a_1 \times \tan 54.7 \text{ degrees} \leqq d_1 \leqq T-(a_1+X-L/2) \times \tan 54.7 \text{ degrees, and}$$

$$a_m \times \tan 54.7 \text{ degrees} \leqq d_m \leqq T-(a_1+a_2+\ldots a_m+X-L/2) \times \tan 54.7 \text{ degrees},$$

in both of the cases.

13. A method for manufacturing a substrate for a liquid discharge head having a silicon substrate provided with a supply port of a liquid, comprising:

preparing a substrate in which one row formed of a plurality of first recesses that are provided from one side face into the inner part of the substrate is provided in the substrate, n rows ($n \geqq 2$) formed of a plurality of second recesses that are provided from the one side face into the inner part of the substrate are provided so as to sandwich the row formed of the first recesses, and where $d_m$ is defined as a depth of the second recesses in an (m)th row ($2 \leqq m \leqq n$) from the row of the first recesses toward the outside, $a_m$ is defined as a distance between an (m−1)th row and the (m)th row, $a_1$ is defined as a distance between the first row of the second recesses and the row of the first recesses, $d_1$ is defined as a depth of the second recesses in the first row, the parameters satisfy relations of $$a_1 \times \tan 54.7 \text{ degrees} \leqq d_1, \text{ and}$$

$$a_m \times \tan 54.7 \text{ degrees} \leqq d_m; \text{ and}$$

etching the substrate anisotropically for the crystal from the one side.

* * * * *